US011131273B2

(12) United States Patent
Abei et al.

(10) Patent No.: US 11,131,273 B2
(45) Date of Patent: Sep. 28, 2021

(54) CHARGE FORMING SYSTEM FOR COMBUSTION ENGINE

(71) Applicant: Walbro LLC, Tucson, AZ (US)

(72) Inventors: Takashi Abei, Sendai (JP); Katsuaki Hamataka, Sendai (JP); Taketoshi Hirama, Watari-gun (JP); Takashi Horikawa, Natori (JP); Tomoya Kawada, Sendai (JP); Nobuyuki Kuroki, Sendai (JP); Shunya Nakamura, Iwanuma (JP); Kazunori Tsubakino, Kakuda (JP); Makoto Waku, Kakuda (JP)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 16/634,276

(22) PCT Filed: Jul. 27, 2018

(86) PCT No.: PCT/US2018/044069

§ 371 (c)(1),
(2) Date: Jan. 27, 2020

(87) PCT Pub. No.: WO2019/023562

PCT Pub. Date: Jan. 31, 2021

(65) Prior Publication Data

US 2021/0088002 A1 Mar. 25, 2021

Related U.S. Application Data

(60) Provisional application No. 62/687,869, filed on Jun. 21, 2018, provisional application No. 62/537,746, filed on Jul. 27, 2017.

(51) Int. Cl.
*F02M 17/02* (2006.01)
*F02M 15/04* (2006.01)

(52) U.S. Cl.
CPC ..... *F02M 17/02* (2013.01); *F02M 15/04* (2013.01)

(58) Field of Classification Search
CPC ..... F02M 17/02; F02M 15/04; F02M 17/00; F02M 19/00; F02M 23/00; F02D 7/00
USPC ..... 123/436
See application file for complete search history.

(56) References Cited

U.S. PATENT DOCUMENTS 3,037,751 A * 6/1962 Phillips ..... F02M 17/04 261/35
4,389,999 A 6/1983 Jaqua
4,499,887 A 2/1985 Billingsley et al.
4,542,726 A 9/1985 Baltz et al.
(Continued)

OTHER PUBLICATIONS

Written Opinion & International Search Report for PCT/US2018/044069 dated Nov. 8, 2018, 15 pages.

*Primary Examiner* — Joseph J Dallo
*Assistant Examiner* — Yi-Kai Wang
(74) *Attorney, Agent, or Firm* — Reising Ethington P.C.

(57) ABSTRACT

In at least some implementations, a charge forming system for a combustion engine includes a first fuel supply device having a first passage from which fuel is discharged for delivery to the engine and a second fuel supply device having a second passage from which fuel is discharged for delivery to the engine. The first passage communicates with the second passage so that the fuel in the first passage is combined with the fuel in the second passage.

21 Claims, 6 Drawing Sheets

(56) References Cited

U.S. PATENT DOCUMENTS

| | | | | |
|---|---|---|---|---|
| 5,018,503 | A * | 5/1991 | Hoshiba | F02B 61/045 123/577 |
| 5,749,338 | A * | 5/1998 | Gohara | F02B 61/045 123/514 |
| 6,439,546 | B1 * | 8/2002 | Galka | F02B 63/02 261/35 |
| 7,152,852 | B1 | 12/2006 | Habu et al. | |
| 2003/0165039 | A1 | 9/2003 | Moran | |
| 2006/0102126 | A1 * | 5/2006 | Nakata | F02M 1/12 123/179.15 |
| 2008/0203194 | A1 * | 8/2008 | Aoki | F02M 61/1853 239/533.12 |
| 2013/0087935 | A1 | 4/2013 | Bostian | |
| 2013/0228152 | A1 * | 9/2013 | Ono | F02D 9/02 123/319 |
| 2016/0040791 | A1 * | 2/2016 | Sasaki | F02M 17/145 137/528 |

* cited by examiner

CHARGE FORMING SYSTEM FOR COMBUSTION ENGINE

REFERENCE TO RELATED APPLICATIONS

This application claims the benefit of U.S. Provisional Application Ser. No. 62/687,869 filed on Jun. 21, 2018 and 62/537,746 filed on Jul. 27, 2017, the entire contents of which are incorporated herein by reference in their entireties.

TECHNICAL FIELD

The present disclosure relates generally to a charge forming system or assembly for a combustion engine.

BACKGROUND

Carburetors are devices that can be used to mix fuel and air to power combustion engines typically including gasoline powered internal combustion spark ignited engines. During certain engine conditions, such as when a cold engine is started or when an engine is accelerating, more fuel may be needed to facilitating starting the engine or to ensure steady engine operation. A choke valve may be used to facilitate starting the engine. Calibration of the carburetor after it is installed on the engine to control the fuel and air delivered to the engine, including but not limited to times when the choke valve is closed, can be time consuming and labor intensive. Further, the engine operating conditions can change over time making the initial calibration or less effective.

SUMMARY

In at least some implementations, a charge forming system for a combustion engine includes a first fuel supply device having a first passage from which fuel is discharged for delivery to the engine and a second fuel supply device having a second passage from which fuel is discharged for delivery to the engine. The first passage communicates with the second passage so that the fuel in the first passage is combined with the fuel in the second passage.

In at least some implementations, the first fuel supply device includes a carburetor that provides a fuel and air mixture to the engine, the first passage has an outlet from which fuel and air are discharged, and the second fuel supply device is downstream of the first fuel supply device and the second passage communicates with the outlet of the first passage.

In at least some implementations, the second fuel supply device provides fuel to the engine to supplement the fuel provided from the first fuel supply device under at least certain engine operating conditions. The first fuel supply device may be coupled to the second fuel supply device which may be coupled to the engine. The second fuel supply device may include an electrically actuated valve to selectively provide and not provide fuel to the second passage. A temperature component may be provided and the valve may be actuated as a function of a signal provided from the temperature component. A control module having a controller may be coupled to the temperature component and to the valve. A speed component may be provided that provides a signal indicative of engine speed and the valve may be actuated as a function of engine speed. The speed component may include a wire coil, such as a coil in which energy is induced as a function of engine speed, for example a coil in which energy is induced as an engine flywheel rotates.

In at least some implementations, a fuel chamber is provided which contains a supply of fuel and which includes a fuel outlet from which fuel flows to the electrically actuated valve through a fuel passage. The electrically actuated valve controls fuel flow through a valve seat and the fuel chamber may be located above the valve seat with respect to the force of gravity so that fuel flows under the force of gravity from the fuel chamber outlet, through the fuel passage and to the electrically actuated valve. The fuel chamber may include an outlet spaced from the fuel outlet and through which air and vapor are permitted to flow out of the fuel chamber. The fuel chamber may include a fuel inlet through which fuel enters the fuel chamber, a valve associated with the fuel inlet to control fuel flow through the fuel inlet and a float received within the fuel chamber and coupled to the valve to actuate the valve.

In at least some implementations, the second fuel supply device includes a main body with a fluid passage through which fuel and air discharged from the first fuel supply device flows, and the second fuel supply device includes a fuel passage with a fuel passage outlet through which fuel flows into the fluid passage for delivery to the engine.

In at least some implementations, a controller is coupled to the electrically actuated valve so that the controller controls opening and closing of the electrically actuated valve, and a wire coil is coupled to the controller, wherein the wire coil either provides a signal to the controller with the controller controlling opening and closing of the electrically valve as a function of the signal or the wire coil provides electrical energy for an ignition event in the engine and the controller controls the timing of the ignition event.

In at least some implementations, a charge forming system for a combustion engine includes a first fuel supply device from which fuel is discharged for delivery to the engine, a second fuel supply device having a fuel passage from which fuel is discharged for delivery to the engine, and at least one suppressor arranged in the fuel passage to attenuate fluid flow in a reverse direction through the fuel passage.

The suppressor may be a check valve that permits fluid flow in a first direction and prevents or inhibits fluid flow in a second direction opposite to the first direction. The suppressor may include a suppressing element having multiple openings that each have a smaller flow area than the portion of the fuel passage in which the suppressor is received. The openings may have a length that is less than twice the maximum width of the opening, where the length is measured parallel to the direction of fluid flow through the opening and the width is measured perpendicular to the direction of fluid flow. The openings may have a length that is greater than twice the maximum width of the opening, where the length is measured parallel to the direction of fluid flow through the opening and the width is measured perpendicular to the direction of fluid flow. The suppressing element may include a screen, wire mesh or disc having multiple spaced apart openings.

In at least some implementations, the suppressor includes a suppressing element having a passage and multiple openings that are radially offset from the suppressing element passage. In at least some implementations, at least two openings are axially offset from the suppressing element passage and radially outwardly spaced from the suppressing element passage.

The various features set forth in the summary may be used in various combinations such that certain embodiments include all or less than all of the complementary or not mutually exclusive features set forth above and described further below.

BRIEF DESCRIPTION OF THE DRAWINGS

The following detailed description of certain embodiments and best mode will be set forth with reference to the accompanying drawings, in which.

DETAILED DESCRIPTION

Figure 1:
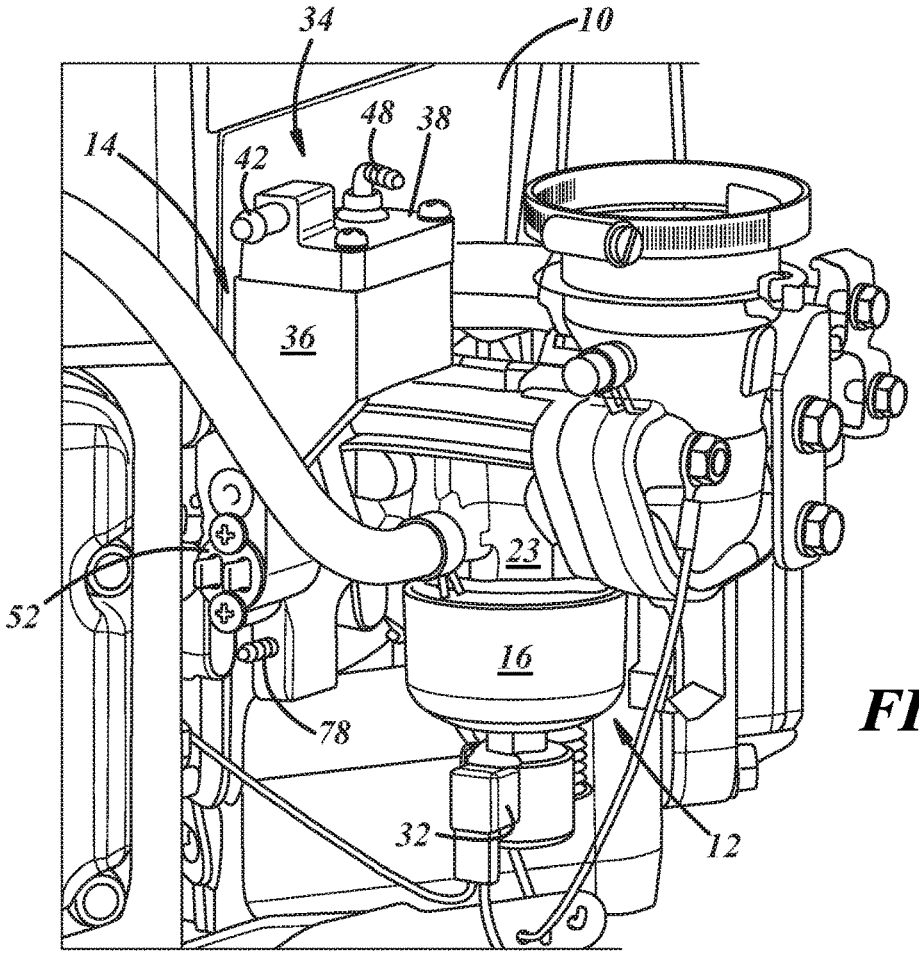
FIG. 1 is a perspective view showing a portion of an engine with a first fuel supply device and a second fuel supply device coupled to the engine.

Referring in more detail to the drawings, FIG. 1 illustrates a combustion engine 10, a first fuel supply device 12 that supplies a fuel and air mixture to the engine, and a second fuel supply device 14 that selectively supplies fuel to the engine. The engine 10 may be a light-duty combustion engine which may include, but is not limited to, all types of combustion engines including two-stroke, four-stroke, carbureted, fuel-injected, and direct-injected engines. Light-duty combustion engines may be used with hand-held power tools, lawn and garden equipment, lawnmowers, grass trimmers, edgers, chain saws, snowblowers, personal watercraft, boats, snowmobiles, motorcycles, all-terrain-vehicles, etc.

Figure 2:
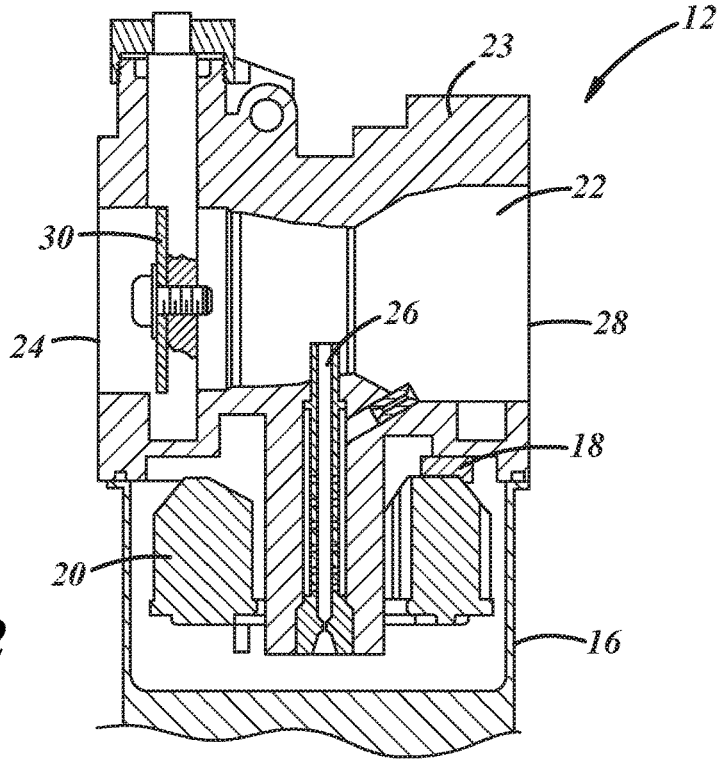
FIG. 2 is a sectional view of a portion of the first fuel supply device of FIG. 1 showing some internal components thereof.

In the example shown in FIGS. 1 and 2, the first fuel supply device is a carburetor 12. While the carburetor 12 may be of any desired type, including (but not limited to) diaphragm carburetors, rotary valve carburetors and float bowl carburetors, the example shown in FIGS. 1 and 2 is a float bowl carburetor. The carburetor 12 may include a fuel bowl 16 in which a supply of fuel is maintained, an inlet valve (shown diagrammatically at 18) that controls fuel flow into the fuel bowl and a float 20 in the fuel bowl that actuates the inlet valve 18. The carburetor 12 may further include a first passage, which may be called a fuel and air mixing passage 22, formed in a main body 23 and having an inlet 24 through which air flows, a fuel passage 26 through which fuel from the fuel bowl flows and an outlet 28 through which a fuel and air mixture flows for delivery to the engine 10. A throttle valve 30 may be rotatably received in the fuel and air mixing passage 22 to control the flow rate of fluid in and through the carburetor 12. The fuel bowl 16 of the carburetor 12 may be constructed and arranged as set forth in U.S. patent application Ser. No. 13/623,943, filed Sep. 12, 2012, and may include a fuel shutoff solenoid 32 (FIG. 1) with or without any accelerator pump as set forth in that application. The carburetor 12 may also be constructed and arranged as set forth in U.S. Pat. No. 7,152,852 with or without a priming pump as set forth therein. The noted application and patent being incorporated herein by reference in their entireties.

Figure 3:
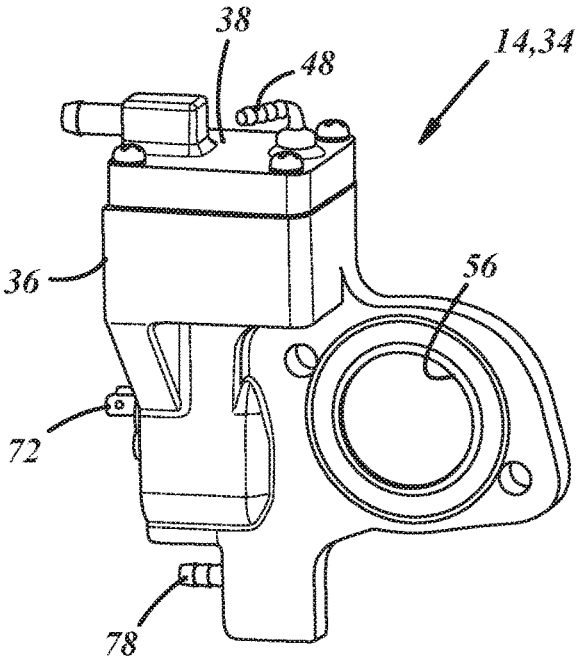
FIG. 3 is a perspective view of the second fuel supply device.
Figure 4:
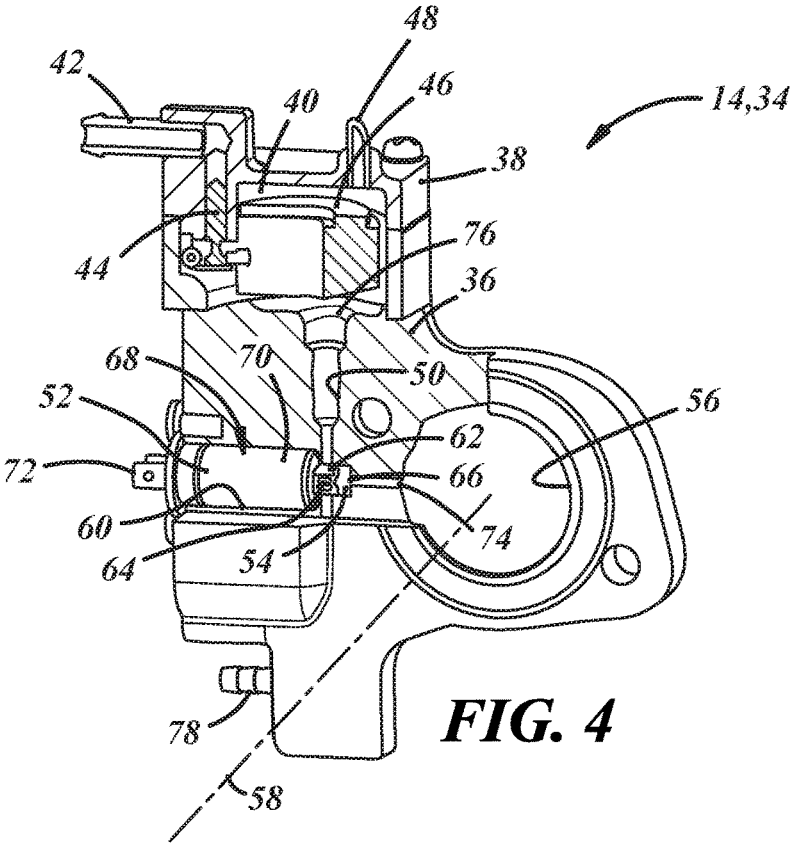
FIG. 4 is a sectional view of the second fuel supply device.

In at least some implementations, and as shown in FIGS. 1, 3 and 4, an insulator 34 is provided between the carburetor 12 and the engine 10 with appropriate gaskets or seals between them. The insulator 34 may include or define the second fuel supply device 14 and may include a main body 36 and a cover 38 connected to the main body. As shown in FIG. 4, the fuel chamber 40 is defined between the cover 38 and main body 36 and a fuel inlet 42 communicates with the fuel chamber. To control the flow of fuel into the second fuel supply device/insulator 34, a valve 44 is associated with the fuel inlet 42. For example, the valve 44 may close to prevent fuel from entering the fuel chamber 40 and may open to permit fuel to flow into the fuel chamber. In the example shown, the valve 44 is coupled to and actuated by a float 46 received within the fuel chamber 40. The float 46 is responsive to changes in the level of fuel in the fuel chamber 40 (e.g. it may be buoyant in the fuel) to selectively open and close the valve 44 and fuel inlet 42. When the level of fuel in the fuel chamber 40 is at a desired maximum level, the float 46 moves the valve 44 into engagement with a valve seat and fuel flow into the fuel chamber 40 is inhibited or stopped altogether. Fuel vapor or air within the fuel chamber 40 may be vented therefrom through an outlet 48 which may be communicated with or lead to a vapor canister which may contain an adsorbent material (e.g. activated charcoal) arranged to limit or prevent the emission of hydrocarbons to the atmosphere. In this way, the fuel chamber 40 may also function as a fuel vapor separator. The insulator 34 may be made from a polymeric or metal material, such as but not limited to, engineering plastics like phenol formaldehyde (PF), polyphenylene sulfide (PPS), polybutylene terephthalate (PBT), polyether ether ketone (PEEK), or aluminum or other metals.

The insulator 34 may further include a fuel passage 50 leading from the fuel chamber 40 to a fuel control valve 52. The fuel passage 50 may be formed in the main body 36, the cover 38 or in a conduit extending externally of the main body and cover, or any combination of these. In the example shown, the fuel passage 50 is formed in the main body 36 and extends through a valve seat 54 of the control valve 52 and to a fluid passage 56, sometimes called a second passage, formed through the main body 36. The valve seat 54 may be annular and arranged to be engaged by a valve head of the control valve 52 to selectively allow and prevent fuel flow through the valve seat and hence, from the fuel chamber 40 to the fluid passage 56. The fluid passage 56 may be aligned and communicated with the first passage/fuel and air mixing passage 22 of the carburetor 12. The body 23 of the carburetor 12 may be engaged with the isolator 34 so that the outlet or downstream end of the fuel and air mixing passage 22 is communicated with the fluid passage 56 and the fuel and air mixture discharged from the fuel and air mixture passage flows through the fluid passage 56 before entering the engine 10. That is, within the flow path from the carburetor 12 to the engine 10, the isolator 34 may be downstream of the carburetor and upstream of the engine. Annular gaskets or seals may be provided between the carburetor 12 and the insulator 34, surrounding the fluid passage 56 and fuel/air mixing passage 22. The main body 36 of the isolator 34, in the area of the fluid passage 56 may be relatively thin in the direction of an axis 58 of the fluid passage 56. The isolator 34 may separate the carburetor 12 from the engine 10, to, for example, isolate the carburetor from heat and vibrations of the engine and permit the carburetor to function better (e.g. by reducing vaporization of fuel in the carburetor and by damping engine vibrations that may affect movement of valves, diaphragms and the like in the carburetor).

The fuel control valve 52 may be received within a cavity 60 in the main body 36 that intersects or is open to the fuel passage 50, for example, at the valve seat 54. When the valve head is closed on the valve seat, fuel is inhibited or prevented from flowing to the fluid passage 56 and when the valve head is off the valve seat, fuel may flow from the fuel chamber 40 to the fluid passage 56 for delivery to the engine 10. The control valve 52 may have an inlet 62 to which fuel is delivered, a valve element 64 (e.g. valve head) that controls fuel flow rate and an outlet 66 downstream of the valve element. To control actuation and movement of the valve element 64, the control valve 52 may include or be associated with an electrically driven actuator such as (but not limited to) a solenoid 68. Among other things, the solenoid 68 may include an outer casing 70 received within the cavity 60 in the main body 36, an electrical connector 72 arranged to be coupled to a power source to selectively energize an internal wire coil to slidably displace an internal armature that drives the valve element 64 relative to the valve seat 54. The solenoid 68 may be constructed as set forth in U.S. patent application Ser. No. 14/896,764, filed Jun. 20, 2014 and incorporated herein by reference in its entirety. Of course, other metering valves, including but not limited to different solenoid valves or commercially available fuel injectors, may be used instead if desired in a particular application.

In at least some implementations, the fuel chamber 40 is above (relative to the force of gravity) the valve seat 54 and above the location of a fuel passage outlet port 74 (i.e. the juncture of the fuel passage 50 with the fluid passage 56) such that fuel flows from the fuel chamber 40 to the fluid passage 56 under the force of gravity and any head or pressure of the fuel within the fuel chamber itself. Hence, the fuel flows under low pressure rather than a higher pressure such as may be caused by a pump acting on the fuel. Further, the fuel inlet 42 may be located above an outlet 76 of the fuel chamber 40 (relative to the force of gravity), and the inlet valve 44 may engage a valve seat located between the inlet 42 and outlet 76 of the fuel chamber 40 such that the valve 44 is located internally of the fuel chamber 40 and generally between the main body 36 and cover 38 in at least some implementations.

In at least some implementations, the fuel from the fuel chamber 40 is not needed to support engine operation in at least some, and up to most, engine operating conditions under which fuel from the carburetor 12 is sufficient to support engine operation. However, the fuel control valve 52 may be selectively opened to provide to the engine 10 fuel from the fuel chamber 40 under certain engine operating conditions. For example, fuel in addition to that provided by the carburetor 12 may be desirable in some applications to facilitate starting a cold engine and to help warm-up the engine. In some applications, fuel may be provided to support engine acceleration or to smooth out engine deceleration or to slow an engine operating at too high of a speed, etc. This additional fuel is provided downstream of the carburetor 12, which may be the first or primary source of fuel for the engine 10. Further, this additional fuel may be provided without a pump, which considerably reduces the cost and complexity of the system while still supporting a wide range of engine operating conditions.

To facilitate draining the fuel chamber 40 and fuel passage 50, the insulator 34 may include a drain outlet 78 that is downstream of the valve seat 54. That is, the valve seat 54 is located between the fuel chamber 40 and the drain outlet 78 with respect to fuel flow from the fuel chamber to the drain outlet. Fuel may be drained to, for example, reduce emissions from the fuel chamber 40, and inhibit or prevent fuel from splashing or spilling out of the fuel chamber as the device that includes the engines is moved or transported while the engine 10 is not operating, and to reduce corrosion or deterioration of components otherwise in contact with the fuel. The drain outlet 78 may be defined in a fitting coupled to the insulator body 36, and a suitable valve may be provided to prevent unintended fuel drain, if desired.

Figure 5:
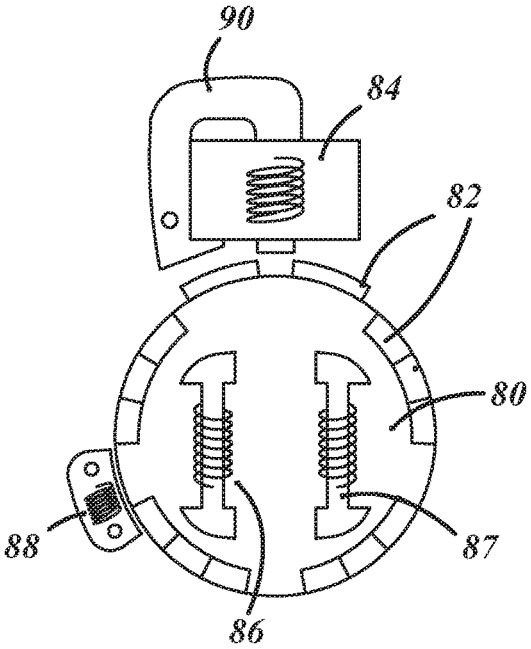
FIG. 5 is a diagrammatic view of a flywheel and coils for an ignition and fuel control system.

When the fuel control valve 52 is opened and the duration of time that the fuel control valve is opened may be controlled by a suitable controller, such as a microprocessor. The microprocessor may include any suitable program, instructions or algorithms to determine when the valve 52 should be opened and when the valve should be closed. Further, control of the valve 52 may be dependent upon engine operating conditions, such as engine speed, which may be determined by one or more sensors or other components. In at least some examples, such as is diagrammatically illustrated in FIG. 5, a flywheel 80 is rotated by the engine and one or more magnets 82 are fixed to the flywheel and are rotated relative to one or more wire coils 84, 86, 87 and 88 as the flywheel is rotated. Passing the magnets 82 by the coils 84-88 generates electricity in the coils which may be used for one or more purposes, including but not limited to, generating a spark for ignition, providing power to the controller/processor, generating power for the fuel control valve 52 and to provide a signal indicative of engine speed (e.g. a VR sensor, generally including coil 88). FIG. 5 diagrammatically illustrates an ignition coil 84 and a lamstack 90 (or laminated stack of plates) that carries the ignition coil 84 and usually other wire coils, generator coils 86, 87, that may be used for spark ignition and other power needs of the system and pickup or VR coil 88.

The coils 84-88, including the VR sensor, provide a signal or voltage variance in accordance with the position and movement of the magnets 82 relative to the coils, and the position of the magnets can be related to the position of the engine 10 within an engine rotation and the time for an engine rotation depends upon the engine speed. In this way, the VR sensor 88 and/or one or more other coils may be monitored to determine engine speed which may be used to control, at least in part, the operation of the fuel control valve 52. In some implementations, the fuel control valve 52 is opened to support initial idle engine operation, or engine operation above idle intended to warm-up the engine. Once the engine speed increases beyond a threshold, the fuel control valve 52 is closed and the engine operation is supported by the fuel and air mixture delivered to the engine 10 by the carburetor 12. If the fuel control valve 52 is used to provide supplemental fuel to the engine 10 during engine acceleration, then the increasing engine speed between engine revolutions can also be detected in the same way and the fuel control valve opened as a result. The ignition and VR coils 84-88 noted herein are often provided in engine fuel systems that do not have the fuel control valve 52 as set forth herein so these components do not represent additional cost in the system and the fuel control valve can be controlled with components already in existence.

Figure 6A:
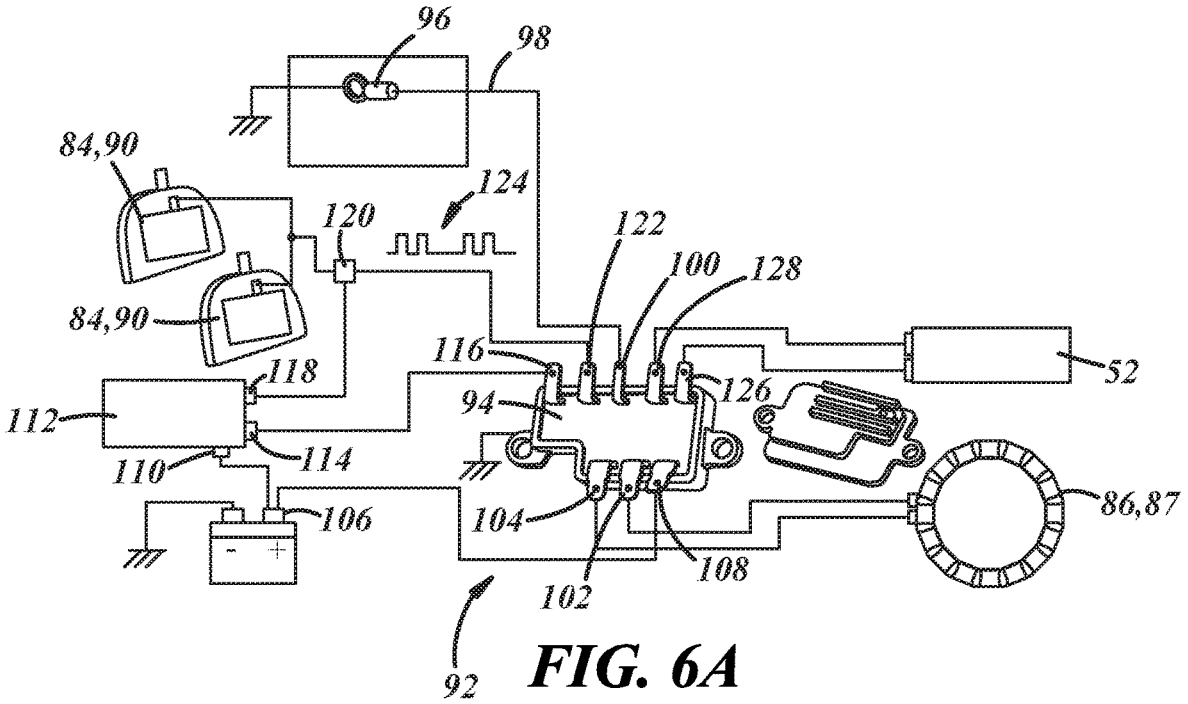
FIG. 6A is a schematic view of an ignition and fuel control system.

Further, the timing of ignition events in the engine 10 may be controlled by an ignition circuit received within a control module 92 (referring now to FIG. 6A) and a controller 94, such as a microprocessor that may be part of the ignition circuit or located remotely from the ignition circuit/control module 92. The fuel control valve 52 may be controlled as a function of temperature, for example a temperature that represents the temperature of the engine 10, so that, for example, fuel is provided when the engine is relatively cold as noted above. In this regard, a temperature sensor or temperature responsive element 96 (one that can provide a signal or indication of temperature) may be incorporated into the system. As shown in FIG. 6A, the temperature sensor may include a temperature component 96 adapted to be coupled to the engine, carburetor 12, insulator 34 or other body. A wire 98 may provide a signal from the temperature component 96 to an input 100 of the controller 94. Further, coil 88 may be coupled to inputs 102 and 104 to provide a signal indicative of engine speed to the controller 94. If available, a battery positive terminal 106 may be coupled to the controller 94 at input 108 and may provide DC power to the controller, and the positive terminal 106 may also be coupled to an input 110 of an ignition switch 112 (which may be used to turn on and off the engine), which also has an input 114 coupled to an output 116 of the controller 94, and an output 118 coupled to the ignition coils 84, 86 to effect an ignition event when commanded by the controller 94. One or more ignition coils 84, 86 (e.g. a primary and secondary) may provide AC input pulses to the controller 94, and a rectifier 120 may be provided to provided rectified power to an input 122 of the controller 94 as shown at 124. Finally, the fuel control valve 52 may be connected to the controller 94 at 126 and 128 to enable control of the opening and closing of the fuel control valve.

Figure 6B:
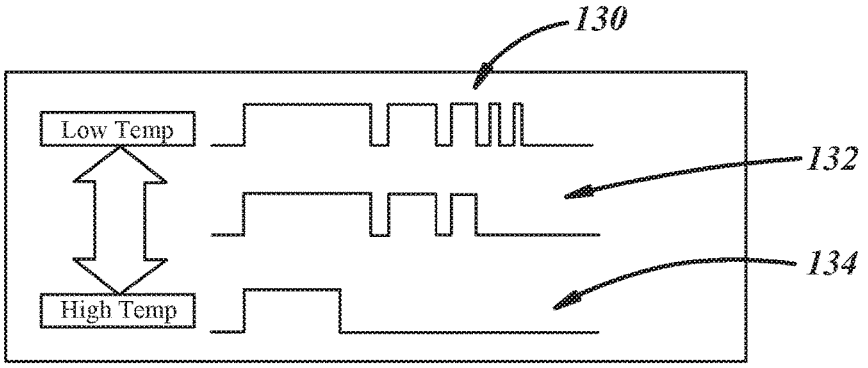
FIG. 6B includes graphs of a control signal for a fuel control valve at different temperatures.

In the graphs shown in FIG. 6B, the control signal for the fuel control valve 52 when a cool or lower engine temperature is indicated by the temperature component 96 is shown at 130, the control signal for an intermediate temperature is shown at 132 and the control signal at higher/warmer temperatures is shown at 134. The peaks indicate that the solenoid is actuated and the fuel control valve 52 is open to provide supplemental fuel to the engine 10 and the valleys indicate that the fuel control valve is closed to inhibit or prevent supplemental fuel flow to the engine from the fuel control valve. It can be seen by comparison of the plots 130-134 that the fuel control valve 52 is activated and open for a longer duration or a greater percentage of the time shown in the graphs for lower engine temperature (shown at 130) than intermediate engine temperature (shown at 132) and for a longer duration for the intermediate engine temperature than the higher engine temperature (shown at 134). Accordingly, in this example and at least some implementations of this concept, supplemental fuel is provided to the engine 10 during starting and initial warming up of the engine, and fuel is provided for a longer duration the colder the engine is. After the engine 10 is suitably warm, the supplemental fuel is not provided as indicated by the flat lines after the last valve actuation in each plot 130-134 which indicate that the fuel control valve 52 remains closed thereafter. Of course, other control schemes may be used including schemes wherein the control valve 52 is opened during normal engine operation to provide fuel in addition to the fuel from the carburetor 12.

The temperature sensor or temperature component 96 could also be integrated into the controller 94 or a control circuit within the control module 92, such as a temperature responsive semi-conductor that has a voltage across it that changes as the temperature of semi-conductor changes. The rectifier 120 may also be within the control module 92, along with the fuel control valve controller 94 and/or the temperature component 96.

Figure 7:
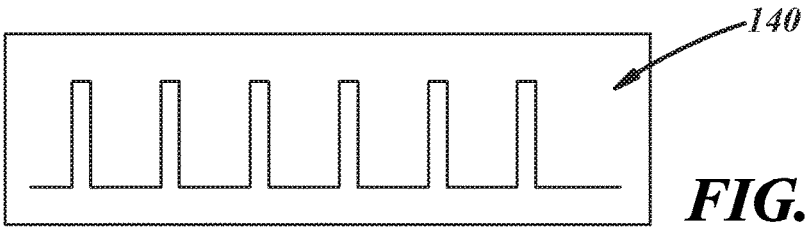
FIG. 7 is a graph of a duty cycle for a fuel injector of the fuel control system during a first or normal engine operating mode.
Figure 8:
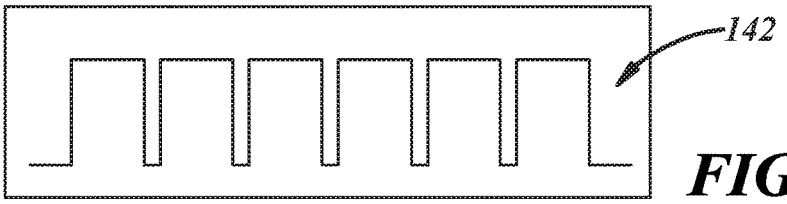
FIG. 8 is a graph of a duty cycle for a fuel injector of the fuel control system during a second or fuel cut engine operating mode.

FIGS. 7 and 8 include plots 140, 142 showing different actuation signals for the fuel control valve. In FIG. 7, the plot 140 illustrates that the fuel control valve 52 is actuated (shown by the peaks) for less time than in FIG. 8. The plot 140 in FIG. 7 may represent a normal actuation signal when the fuel control valve 52 is used to provide supplemental fuel to the engine during normal engine operation. The plot 142 in FIG. 8 may represent an actuation signal that provides more fuel to the engine (e.g. opens the fuel control valve 52 more often and/or for longer total duration) resulting in a richer than normal fuel and air mixture being provided in combination from the carburetor 12 and via the fuel control valve 52. The additional fuel provided through the fuel control valve 52 from a signal like 142 may drain the fuel chamber 40 of fuel (assuming the fuel tank is empty or an upstream valve has been closed so that when the float valve 18 opens, additional fuel is not provided into the fuel chamber 40). This may be desirable, for example, before the device including the engine is stored to prevent corrosion of the fuel control valve and associated seals which may occur when such components are exposed to fuel for an extended period of time. Accordingly, this fuel reduction mode may be provided in at least some implementations and may be implemented by an operator of the device/engine before the device/engine are stored for some duration of time. In the fuel reduction mode, the valve may be opened 10% more than in the normal mode and the valve may be opened up to 100% of the time to drain the fuel. Fuel reduction mode could be initiated via software (e.g. a selected menu item on a user interface) or by changing the state of a switch.

Figure 9:
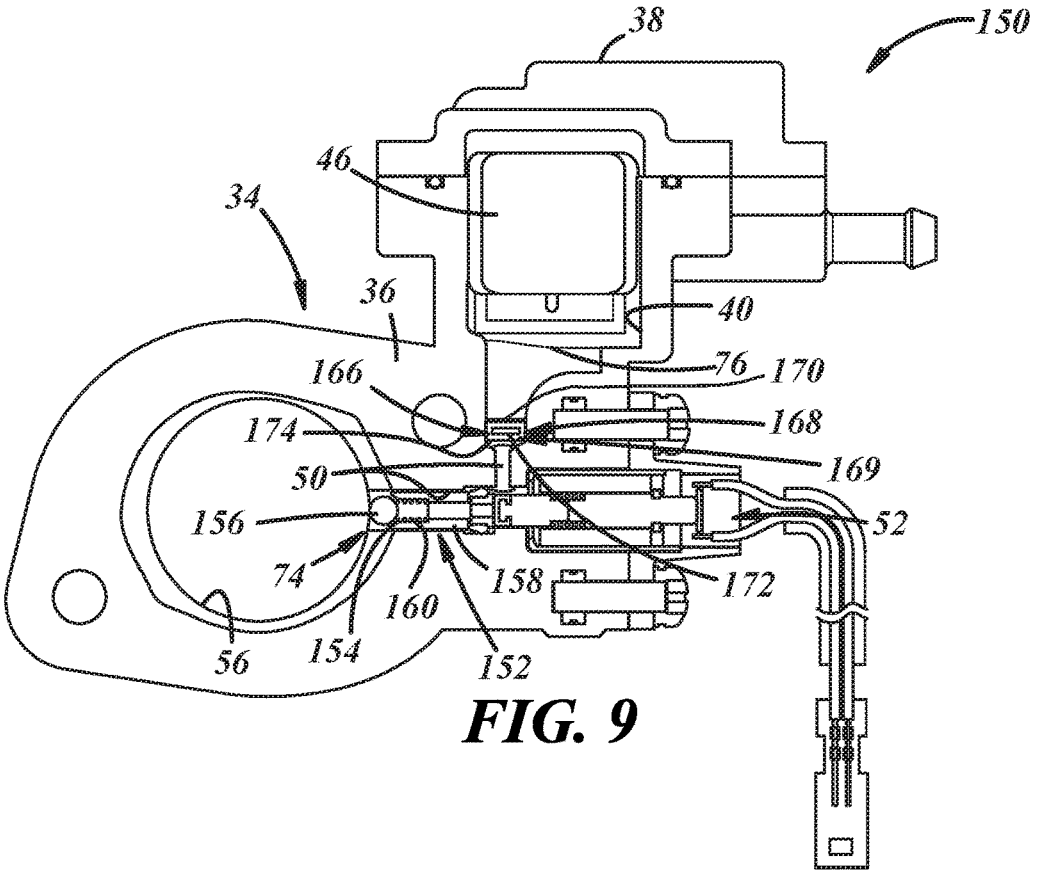
FIG. 9 is a sectional view of a second fuel supply device with a fuel passage valve having or defining a first suppressor and showing a second suppressor between the fuel control valve and fuel chamber.

FIG. 9 illustrates a second fuel supply device 150 that is similar to the second fuel supply device 14 described above, and which may be provided between a first fuel supply device, such as a carburetor 12, and an engine 10, as set forth above. To facilitate description and understanding of the second fuel supply device 150 the same reference numbers will be used for components or features of this device that are the same as or similar to those set forth above with regard to the device 14. For example, the second fuel supply device 150 may include an insulator 34 having a body 36 and cover 38, and may define a fuel chamber 40 in which a float 46 is received to actuate an inlet valve (not shown). The fuel chamber 40 may have an outlet 76 that leads to a fuel passage 50, and a fuel control valve 52 may control the flow of fuel from the fuel passage 50 to the fuel passage outlet 74 that opens into the fluid passage 56. In this way, the fuel control valve 52 may control the flow of fuel from the second fuel supply device to the fluid passage 56, and hence, to the engine.

In at least some implementations, it may be desirable to inhibit or restrict fluid communication between the fuel passage outlet 74 and the fuel chamber 40. For example, if an engine backfire occurs, the resulting combustion pressure may be high enough to open the fuel control valve 52 and combustion may occur within the fuel passage 50 and/or fuel chamber 40. The issue may also occur if the fuel control valve 52 is open when the backfire occurs. In addition to or instead of designing the fuel control valve 52 to remain closed under the pressures associated with a backfire event, which may increase the cost, size and heat generated by the valve 52, one or more suppressors may be provided at or between the fuel chamber outlet 76 and the fuel passage outlet 74. The suppressors may inhibit or prevent direct fluid communication between the fuel passage outlet 74 and the fuel chamber outlet 76, and/or may inhibit or prevent the travel of debris into the fuel passage 50 or into the fuel chamber 40 due to backpressure or a backfire event.

In the example shown in FIGS. 9-12, a first suppressor 152 is provided between the fuel control valve 52 and the fuel passage outlet 74. The first suppressor 152 may be arranged to permit fluid flow from the fuel control valve 52 to the fuel passage outlet 74, but to inhibit or prevent direct fluid flow or communication in the opposite direction. In this example, the first suppressor is a check valve 152 that includes a fluid passage 153 communicated with the fuel passage 50, a valve seat 154 through which fluid flows and a suppressing element or valve head 156 that selectively closes against the valve seat to inhibit or prevent fluid flow. The valve seat 154 may be annular, may surround or define part of the fuel passage 50 and be defined by a valve body 158 that may be received at least partially within the fuel passage 50, or the valve seat could be defined by the insulator body 36, surrounding the fuel passage 50. The valve head 156, in this example, is a ball or sphere of a size to close against the full annular extent of the valve seat 154. A spring 160 or other biasing member may hold the valve head 156 open, spaced from the valve seat 154, until a force sufficient to engage the valve head with the valve seat is applied to the valve head. In the example shown, the spring 160 is a coil spring and has a first end that bears against the valve head 156 and a second end that bears against the valve body 158 or some other structure, such as a surface of the insulator body 36. The valve head 156 may be held in place by a retainer 162 that may be formed in the same piece of material as the valve body 158, or formed separately from the valve body and coupled to the valve body or to the insulator body 36. The retainer 162 may be a tubular body fitted over the valve body 158 (in some implementations) and have one or more voids 164 that are open even when the valve head 156 is engaged with the retainer, to permit fluid flow from the fuel passage 50 through the suppressor 152. Fluid flow in the opposite direction, or pressure from a backfire or other pressure anomaly downstream of the valve head 156, will close the valve head against the valve seat 154 to prevent fluid flow through the suppressor 152.

A second suppressor 166 may be provided at or between the fuel chamber 40 and the fuel control valve 52. In the example of FIG. 9, a check valve 166 is provided between the fuel chamber outlet 76 and the fuel control valve inlet 62. That is, the check valve 166 is provided within the fuel passage 50. The check valve 166 may have any desired construction and arrangement and is shown as having a valve body 168 that is press fit into the fuel passage 50 and has a through passage 169 defined in part by a valve seat 170. A disc-shaped suppressing element or valve head 172 is received between the valve seat 170 and one or more retaining surfaces 174 axially spaced from the valve seat to permit the valve head to move relative to the valve seat between an open position spaced from the valve seat and permitting fluid flow through the valve body passage 169 from the fuel chamber 40 to the fuel control valve 52, and a closed position engaged with the valve seat and preventing fluid flow through the passage 169 in the direction leading to the fuel chamber 40. In the example shown, the retaining surface(s) 174 is defined by a surface of the insulator body 36, although the retaining surfaces could be defined by the valve body 168, or by another component that may be secured to the valve body and/or the insulator body.

Figure 10:
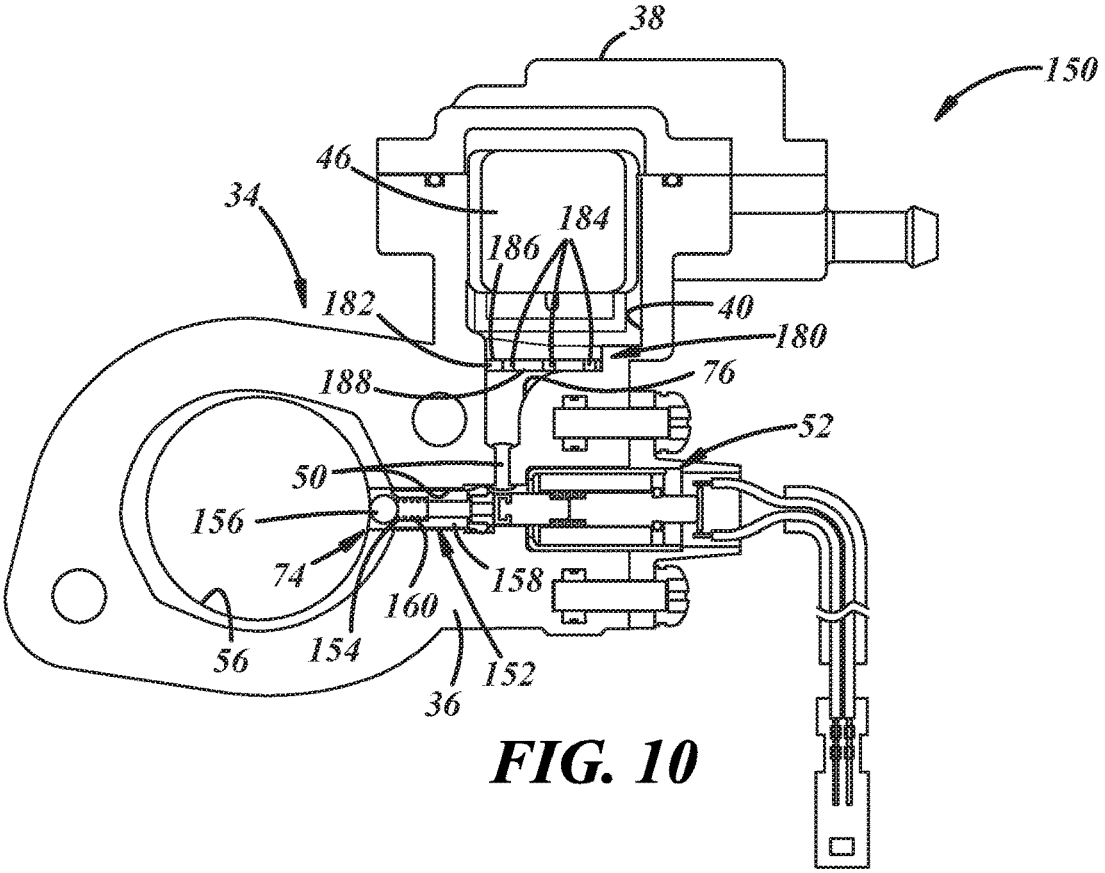
FIG. 10 is similar to FIG. 9 but shows a different second suppressor.
Figure 11:
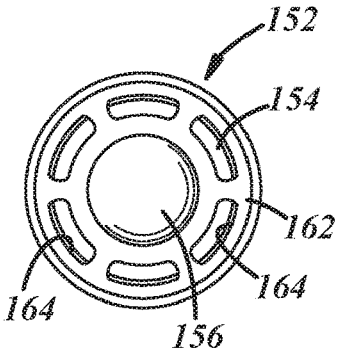
FIG. 11 is an end view of the fuel passage valve.
Figure 12:
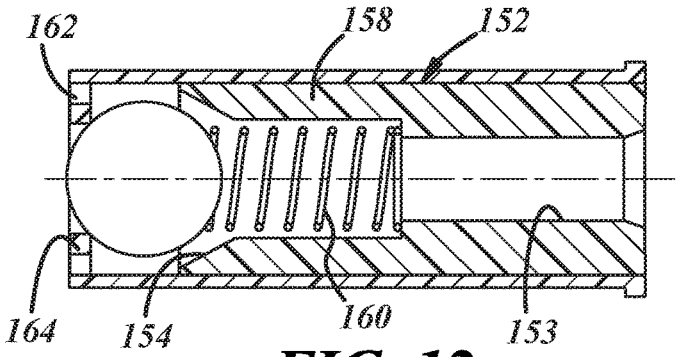
FIG. 12 is a cross sectional view of the valve.

In the example shown in FIG. 10, the second suppressor 180 includes a suppressing element 182 in the form of a screen or other component having pores or spaced apart openings 184 through which fluid is separated into multiple flow paths. The screen 182 may be flat, with oppositely facing first and second surfaces 186, 188 that may be generally planar and shaped to fit in the bottom of the fuel chamber 40. The screen 182 may be immediately upstream from, that is, right at the fuel chamber outlet 76 and may prevent larger particles from passing therethrough, and may also suppress any flame prior to the flame reaching the fuel chamber 40. The screen 182 may be press-fit into a complementarily shaped recess or counter bore in the insulator body 36, or otherwise retained in a desired assembled position (e.g. by a fastener, adhesive, heat stack or weld). The openings 184 in the screen 182 or porous member may be between 0.002 mm and 1 mm in diameter or maximum width (if not circular), in at least some implementations. While a purpose may be to inhibit flames passing through, in at least some implementations, the suppressor may be constructed with openings of smaller size and provide some filtration of fuel, if desired.

Figure 13:
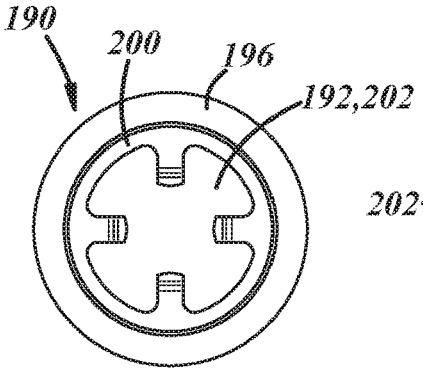
FIG. 13 is an end view of a fuel passage valve.
Figure 14:
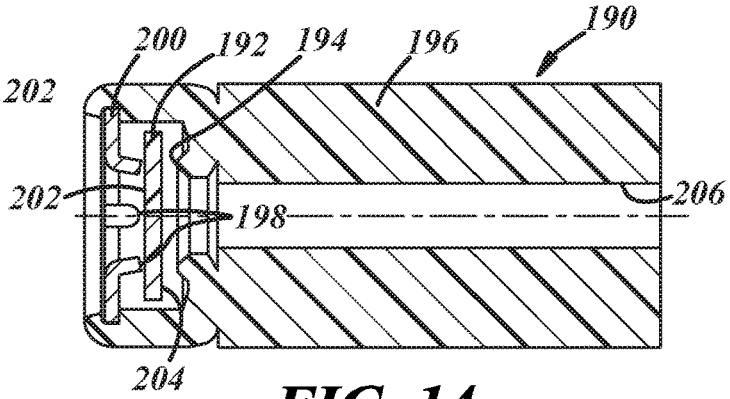
FIG. 14 is a cross sectional view of the valve of FIG. 13.

FIGS. 13-24 show different suppressor constructions that may be used in place of the suppressors described above. FIGS. 13 and 14 show a suppressor 190 having a disc-shaped valve head 192 or suppressing element that travels between a valve seat 194 defined by a valve body 196 and stop surfaces 198 defined by a retainer 200 that is pressed into or otherwise connected to the valve body 196. In this example, the valve head 192 is a solid body without holes formed therethrough, and has a circular perimeter and flat, oppositely facing first and second surfaces 202, 204. When the valve head 192 is engaged with the stop surfaces 198, fluid may still flow through the valve body 196, such as through a central passage 206 formed through the valve body that defines part of the fuel passage 50 between the fuel chamber 40 and the fuel passage outlet 74. And when the valve head 192 is engaged with the valve seat 194, fluid flow through the valve body passage 206 may be prevented or substantially inhibited. The valve body 196 may instead include openings formed therethrough, with the openings sized to trap any larger particles, or to suppress and attenuate any flame passing therethrough by dividing the flame/air flow into separate, smaller streams. The suppressor 190 more readily permits fluid flow in the direction from the fuel chamber 40 to the fuel passage outlet 74, than in the opposite direction.

Figure 15:
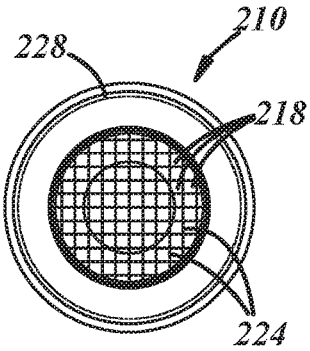
FIG. 15 is an end view of a fuel passage valve.
Figure 16:
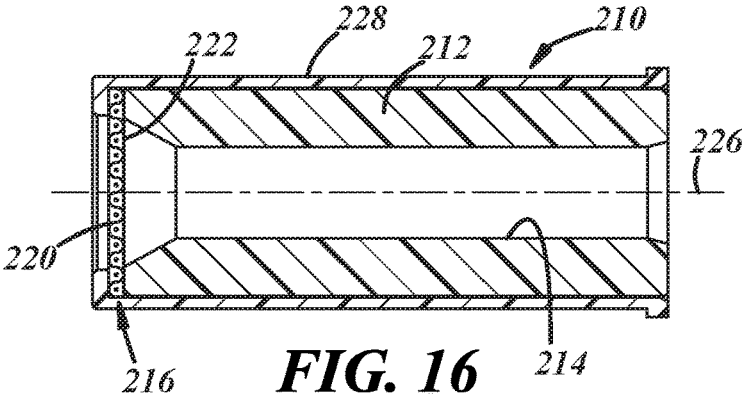
FIG. 16 is a cross sectional view of the valve of FIG. 15.

FIGS. 15 and 16 illustrate a suppressor 210 having a body 212 with a passage 214 therethrough that defines part of or is communicated with the fuel passage 50, and a suppressing element 216 secured to the body. The body 212 may be press-fit or otherwise secured in position relative to the insulator body 36. The suppressing element 216 spans the passage 214 such that all fluid that flows through the passage must pass through the suppressing element. To permit fluid flow therethrough, the suppressing element 216 includes one or more openings 218 that are smaller in flow area than is the passage 214. In the example shown, the suppressing element 216 is a thin disc having opposed, generally flat, planar sides or faces 220, 222, and the openings 218 are defined by spaces bounded by wires 224 in a wire mesh, screen or woven material. The suppressing element 216 (e.g. it's faces 220, 222) may be positioned perpendicular to a centerline 226 of the passage 214, or within thirty degrees of perpendicular. The suppressing element 216 may be positioned at either end of the body 212 or anywhere in between. In the example shown, a tubular retainer 228 is received over the body 212 with the suppressing element 216 trapped between the bodies 212, 228. Further, the suppressing element 216 could be directly inserted into and/or otherwise carried by the insulator body 36 spanning the fuel passage 50, without any body being needed to carry the suppressing element.

Figure 17:
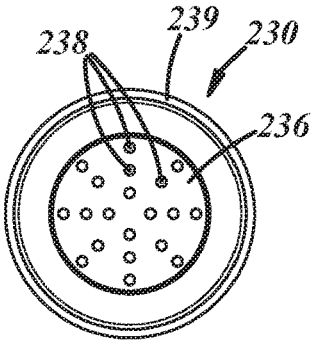
FIG. 17 is an end view of a fuel passage valve.
Figure 18:
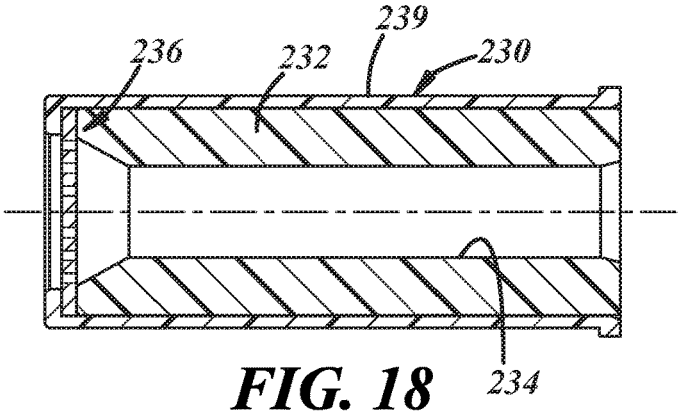
FIG. 18 is a cross sectional view of the valve of FIG. 17.

FIGS. 17 and 18 illustrate a suppressor 230 similar to that shown in FIGS. 15 and 16. This suppressor 230 has a body 232 with a passage 234 therethrough that defines part of the fuel passage 50, and a suppressing element 236 secured to the body. The suppressing element 236 includes multiple, spaced apart passages or openings 238 that extend through the suppressing element and may be arranged in any desired pattern. The openings 238 function similarly to the openings 218 in the screen or mesh described above. This suppressing element 236 may be carried by the body 232, or it could be directly inserted into and/or otherwise carried by the insulator body 36 spanning the fuel passage 50, without any body being needed to carry the suppressing element. In some implementations, a retainer 239 is received over the body 232 with the suppressing element 236 trapped between the bodies 232, 239. The suppressing element 236 in this example and that shown in FIGS. 15 and 16 is thin, that is, it has a short length in the direction of fluid flow. In at least some implementations, the length of a suppressing element opening 238 is less than twice the maximum width of the opening, where the width is measured perpendicular to fluid flow, and is the diameter of the opening in instances where the openings are circular.

Figure 19:
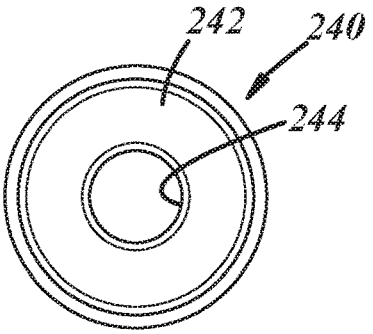
FIG. 19 is an end view of a fuel passage valve.
Figure 20:
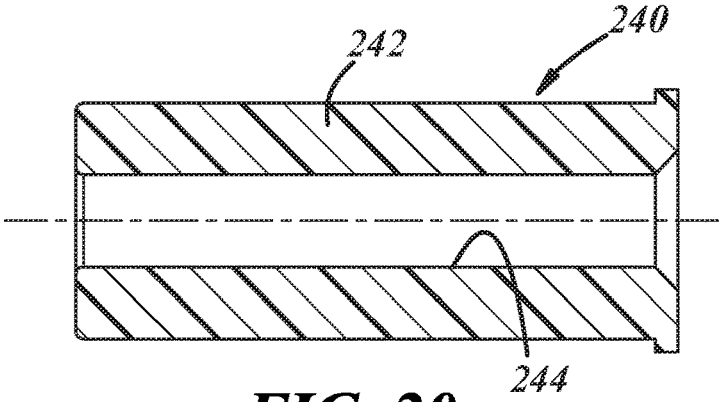
FIG. 20 is a cross sectional view of the valve of FIG. 19.

In FIGS. 19 and 20, the suppressor 240 has a body 242 with a single passage 244 therethrough. The passage 244 has a smaller cross-sectional flow area (taken perpendicular to the direction of fluid flow therethrough) than the remainder of the fuel passage 50 between the fuel passage outlet 74 and the outlet 66 of the fuel control valve 52, when the suppressor 240 is received in that section of the fuel passage 50, or between the fuel chamber outlet 76 and the fuel control valve inlet 62 when the suppressor is received in that section of the fuel passage. The smaller passage 244 attenuates any flame or flow of combustible material to reduce the travel thereof.

Figure 21:
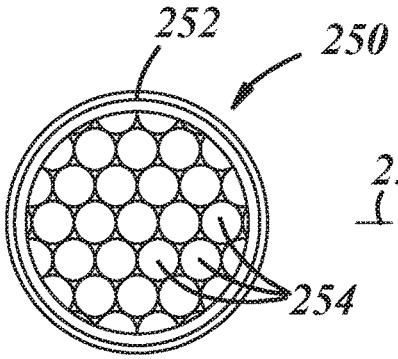
FIG. 21 is an end view of a fuel passage valve.
Figure 22:
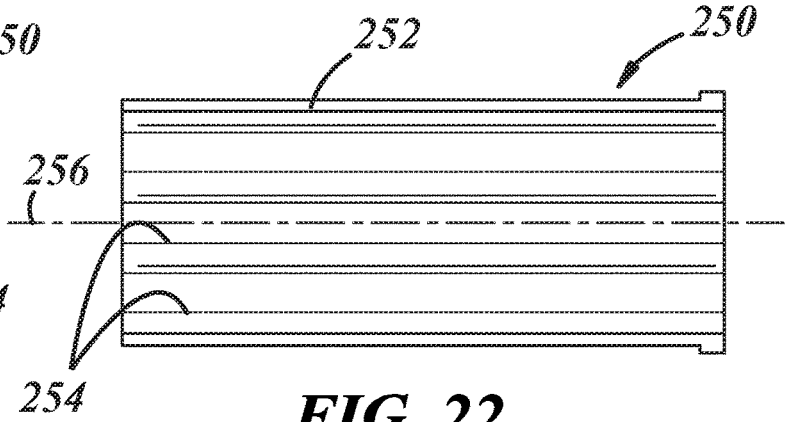
FIG. 22 is a cross sectional view of the valve of FIG. 21.

In FIGS. 21 and 22, the suppressor 250 includes a body 252 that is positioned within the fuel passage 50 at or between the fuel chamber outlet 76 and the fuel passage outlet 74. The body 252 has multiple passages 254 through which fluid flows. The passages 254 collectively define part of the fuel passage 50 such that all fuel that flows through the fuel passage 50 must flow through the body 252 before being discharged into the fluid passage 56. Each passage 254 is smaller in cross-sectional flow area (taken perpendicular to the direction of fluid flow therethrough) than is the portion of the fuel passage 50 in which the body 252 is received. The body 252 has an axis 256 parallel to the direction of fluid flow through the passages 254 and each passage 254 has an axial length that is at least twice as great as the maximum width of that passage 254, where the width is measured perpendicular to fluid flow, and is the diameter of the passage 254 in instances where the passages are circular.

Figure 23:
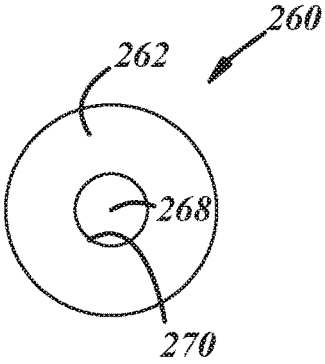
FIG. 23 is an end view of a fuel passage valve.
Figure 24:
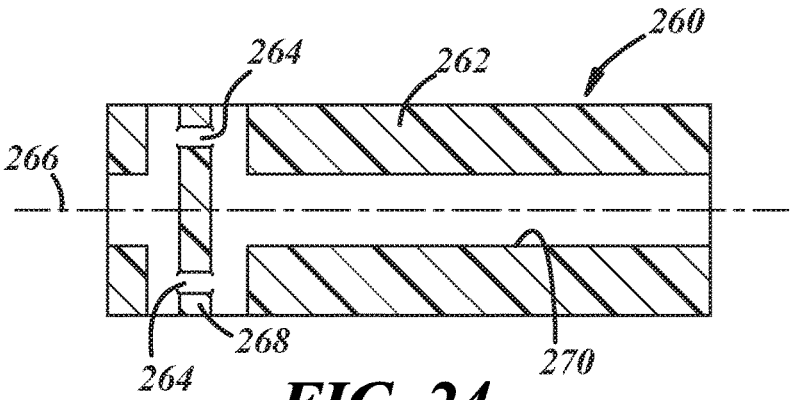
FIG. 24 is a cross sectional view of the valve of FIG. 23.

In FIGS. 23 and 24, the suppressor 260 includes a body 262 that has or defines a tortuous or convoluted fluid flow path. The flow path is defined by openings 264 (voids, passages, etc) that are offset and not aligned with regard to the direction of fluid flow, which may be parallel to a centerline 266 of the body 262. The openings 264 are staggered in two dimensions, which may be called axial and radial (relative to the axis or centerline 266 of the body 262) so that fluid cannot flow straight, axially through the body, but must turn radially one or more times to flow through at least two axially spaced apart and radially offset openings 264. The tortuous flow path attenuates or suppresses a flame or particles from traveling therethrough. The body 262 may include a suppressing element 268 that is carried by the body and which includes multiple openings 264 radially offset from a passage 270 through the body. In the example shown, the body 262 includes one central passage 270 and the suppressing element 268 includes multiple openings 264 spaced radially outwardly from the passage 270, with no suppressing element opening 264 radially aligned or overlapped with the passage 270. Thus, fuel flowing through the passage 270 encounters the suppressing element 268 and must flow radially outwardly to the openings 264 in the suppressing element 268. After passing through the suppressing element 268, that fuel must then flow radially inwardly to again flow through the central passage 270, or to then flow into the fuel passage 50 which is aligned with the central passage 270. That is, the suppressing element 268 may be positioned at either end of the body 262 or anywhere in between the ends of the body.

The forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A charge forming system for a combustion engine, comprising:

a first fuel supply device having a first passage from which fuel is discharged for delivery to the engine; and a second fuel supply device having a second passage from which fuel is discharged for delivery to the engine, wherein the first passage communicates with the second passage so that the fuel in the first passage is combined with the fuel in the second passage, wherein the first fuel supply device includes a carburetor that provides a fuel and air mixture to the engine, and the first passage has an outlet from which fuel and air are discharged from the first fuel supply device, and wherein the second fuel supply device is downstream of the first fuel supply device outlet and the second passage communicates with the outlet of the first passage.

2. The system of claim 1 wherein the second fuel supply device provides fuel to the engine to supplement the fuel provided from the first fuel supply device under at least certain engine operating conditions.

3. The system of claim 1 wherein the first fuel supply device is coupled to the second fuel supply device which is coupled to the engine.

4. The system of claim 1 wherein the second fuel supply device includes an electrically actuated valve to selectively provide and not provide fuel to the second passage.

5. The system of claim 4 which includes a temperature sensor or temperature component and wherein the valve is actuated as a function of a signal provided from the temperature component.

6. The system of claim 4 which includes a speed component that provides a signal indicative of engine speed and wherein the valve is actuated as a function of engine speed.

7. The system of claim 6 wherein the speed component includes a wire coil.

8. The system of claim 5 which includes a control module having a controller coupled to the temperature component and to the valve.

9. A charge forming system for a combustion engine, comprising:

a first fuel supply device having a first passage from which fuel is discharged for delivery to the engine; and a second fuel supply device having a second passage from which fuel is discharged for delivery to the engine, wherein the first passage communicates with the second passage so that the fuel in the first passage is combined with the fuel in the second passage, wherein the second fuel supply device includes an electrically actuated valve to selectively provide and not provide fuel to the second passage, and which also includes a fuel chamber in which a supply of fuel is maintained and which includes a fuel outlet from which fuel flows to the electrically actuated valve through a fuel passage, and wherein the electrically actuated valve controls fuel flow through a valve seat and wherein the fuel chamber is located above the valve seat with respect to the force of gravity so that fuel flows under the force of gravity from the fuel chamber outlet, through the fuel passage and to the electrically actuated valve.

10. The system of claim 9 which also includes an outlet of the fuel chamber spaced from the fuel outlet and through which air and vapor are permitted to flow out of the fuel chamber.

11. The system of claim 10 which also includes a fuel inlet through which fuel enters the fuel chamber, a valve associated with the fuel inlet to control fuel flow through the fuel inlet and a float received within the fuel chamber and coupled to the valve to actuate the valve.

12. The system of claim 3 wherein the second fuel supply device includes a main body with a fluid passage through which fuel and air discharged from the first fuel supply device flows, the second fuel supply device including a fuel passage with a fuel passage outlet through which fuel flows into the fluid passage for delivery to the engine.

13. The system of claim 4 which also includes a controller coupled to the electrically actuated valve so that the controller controls opening and closing of the electrically actuated valve, and a wire coil coupled to the controller, wherein the wire coil either provides a signal to the controller with the controller controlling opening and closing of the electrically valve as a function of the signal or the wire coil provides electrical energy for an ignition event in the engine and the controller controls the timing of the ignition event.

14. A charge forming system for a combustion engine, comprising:

a first fuel supply device from which fuel is discharged for delivery to the engine;

a second fuel supply device having a fluid passage and fuel passage from which fuel is discharged into the fluid passage for delivery to the engine, the second fuel supply device having a fuel chamber in which a supply of fuel is maintained and which includes a fuel outlet from which fuel flows, and wherein the second fuel supply device includes an electrically actuated valve that controls fuel flow through a valve seat and wherein fuel flows under the force of gravity from the fuel chamber outlet, through the fuel passage and to the electrically actuated valve; and at least one suppressor arranged in the fuel passage to attenuate fluid flow in a reverse direction through the fuel passage wherein at least one of said at least one suppressor is located between the electrically actuated valve and the fluid passage.

15. The system of claim 14 wherein the suppressor is a check valve that permits fluid flow in a first direction and prevents or inhibits fluid flow in a second direction opposite to the first direction.

16. The system of claim 14 wherein the suppressor includes a suppressing element having multiple openings that each have a smaller flow area than the portion of the fuel passage in which the suppressor is received.

17. The system of claim 16 wherein the openings have a length that is less than twice the maximum width of the opening, where the length is measured parallel to the direction of fluid flow through the opening and the width is measured perpendicular to the direction of fluid flow.

18. The system of claim 16 wherein the openings have a length that is greater than twice the maximum width of the opening, where the length is measured parallel to the direction of fluid flow through the opening and the width is measured perpendicular to the direction of fluid flow.

19. The system of claim 16 wherein the suppressing element includes a screen, wire mesh or disc having multiple spaced apart openings.

20. The system of claim 14 wherein the suppressor includes a suppressing element having a passage and multiple openings that are radially offset from the suppressing element passage.

21. The system of claim 20 wherein at least two openings are axially offset from the suppressing element passage and radially outwardly spaced from the suppressing element passage.

* * * * *